United States Patent [19]

Covell

[11] 3,990,655

[45] Nov. 9, 1976

[54] DEVICE FOR CARRYING AND SECURING SKIS

[75] Inventor: Calvin J. Covell, Los Angeles, Calif.

[73] Assignee: Covell Enterprises, Los Angeles, Calif.

[22] Filed: July 24, 1975

[21] Appl. No.: 598,554

[52] U.S. Cl. ..... 224/45 S; 24/73 SG; 24/81 SK; 70/58; 280/11.37 A

[51] Int. Cl.[2] ..... B65D 69/00

[58] Field of Search ..... 224/45 S, 45 R, 42.1 G, 224/42.1 F, 50, 45 P, 45 N, 45 W; 280/11.37 K, 11.37 A, 11.37 C, 11.37 E, 11.37 R; 211/60 SK; 70/14, 18, 58; 24/16 R, 73 SG, 81 SK, 248 L, 262 R, 90 W

[56] References Cited

UNITED STATES PATENTS

| | | | |
|---|---|---|---|
| 2,384,850 | 9/1945 | Poor | 211/605 K |
| 3,181,319 | 5/1965 | Hudon | 70/14 |
| 3,191,830 | 6/1965 | Goetz | 224/45 N |
| 3,718,242 | 2/1973 | Larson | 224/45 S X |
| 3,754,420 | 8/1973 | Oellerich | 280/11.37 A X |

*Primary Examiner*—Robert J. Spar
*Assistant Examiner*—Donald W. Underwood
*Attorney, Agent, or Firm*—W. Edward Johansen

[57] ABSTRACT

The invention is a device for carrying skis and poles of a skier in a ski resort area. The device includes a rectangular, plastic support member, with a top end and a bottom end, a rectangular, plastic base, to which the bottom end of the support member is attached, a pair of wings, each having a top end and a bottom end hinged to the base, and a handle attached to the top end of the support member. The wings have compression pads disposed on their inner surfaces and are held in the closed position by a plastic tab with several holes held by an insert. The device is also used as a security device by incorporating a wire cable as the insert and joining the ends of the wire cable with a lock.

3 Claims, 7 Drawing Figures

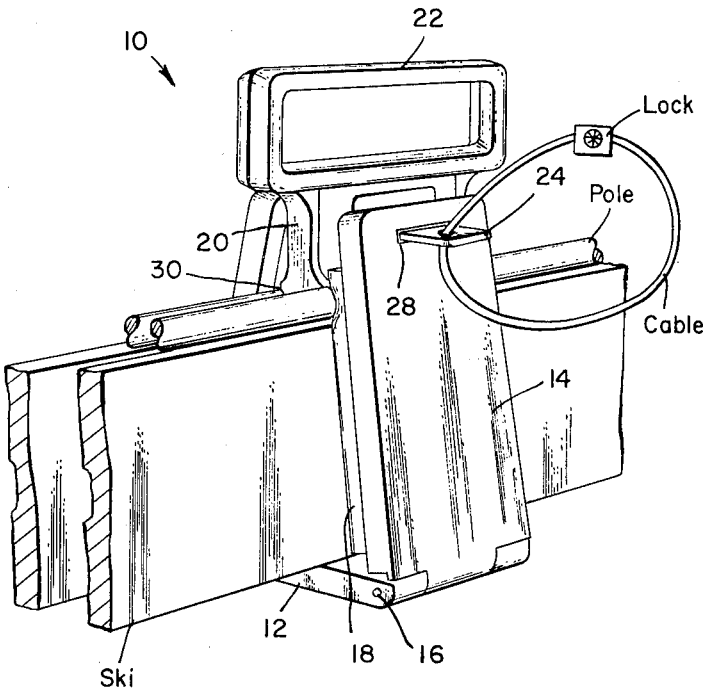
Fig. 1.
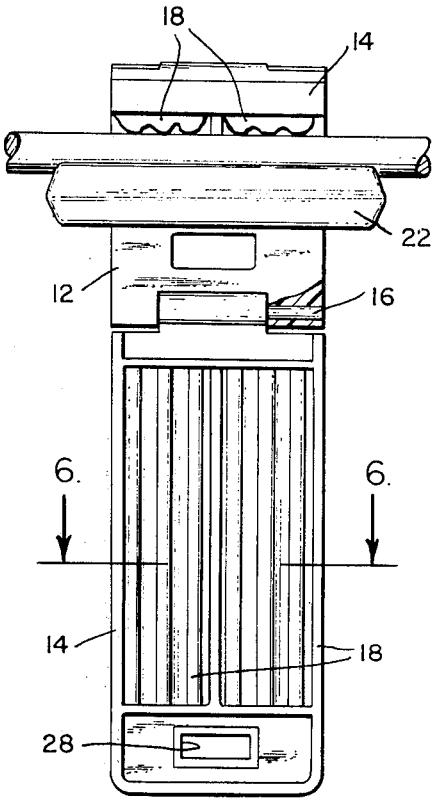
Fig. 5.
Fig. 6
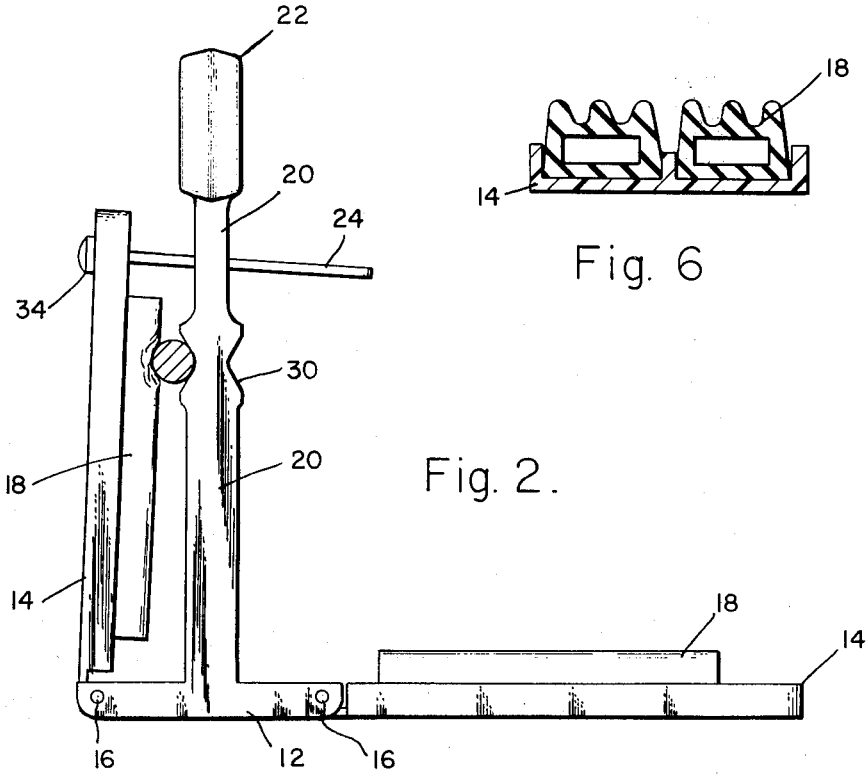
Fig. 2.

DEVICE FOR CARRYING AND SECURING SKIS

BACKGROUND OF THE INVENTION

1. Field of the Invention

The present invention relates to a device for carrying skis and poles, and more particularly to a carrying device which also provides security for the skis and poles when a skier leaves them unattended in a ski resort area.

2. Description of the Prior Art

At a ski resort area a skier usually parks his car or departs from a bus a considerable distance from the skiing area. Typically, the skier carries his skis and poles over his shoulder and his ski boots in a boot tree which he carries in his hand. This method of carrying skis is dangerous to the skier because ice and snow make the grounds of the ski resort area treacherous to walk on while so encumbered and more so because the skier has raised his center of gravity by placing his skis on his shoulder. Some skiers bind their skis together at each end, loop one pole strap about each end while linking the basket of each pole to the pole strap of the other pole, and carry their skis and poles in the same manner as they carry a boot tree. This method of carrying skis is much safer than carrying skis on the skier's shoulder because his center of gravity is lowered rather than raised thereby making him less likely to slip and fall on the ice covered grounds of the ski resort area.

Another problem a skier encounters at a ski resort area is that whenever he decides to take a break from skiing and removes his skis he must guard against theft by locking up his skis in ski lockers provided by the resort management near the ski lodge. There are never enough ski lockers available to accommodate all skiers at any given ski resort area. The scarcity of ski lockers is a source of inconvenience to the skier. Some skiers are presently using a wire cable and a combination lock to secure their skis, but this cable is inadequate for carrying skis.

Presently there are no devices for carrying skis and poles that allow the skier to secure his skis while he is on the ski slope. There are also no devices for carrying skis which subject the skis and poles to a minimum of stress.

In any sport or recreational activity it is essential to have the equipment in good working order. With this in mind it seems that the stress placed on the pole strap and pole itself when the poles are used to carry the skis by the second method described above will damage the pole strap and the pole. Also the skis are not rigidly held in place and have a tendency to become unbalanced causing the skier to slip and fall or the skis to slide out of the loops either hitting another skier or the ground.

SUMMARY OF THE INVENTION

In view of the foregoing factors and conditions characteristic of the prior art, it is a primary object of the present invention to provide a device for carrying skis and poles of a skier while he is at a ski resort area.

It is another object of the present invention to provide a carrying device for skis and poles which will serve also as a device for securing the skier's skis and poles while he is on the ski slopes.

It is still another object of the present invention to provide a carrying device for skis that can be economically fabricated because the design of the device is simple and straight-forward and the device is formed from plastic.

It is yet another object of the present invention to provide a carrying device for skis and poles that does not increase the skier's burden and that may be utilized speedily with efficiency by the skier.

Another object of the present invention is to provide a carrying device for skis and poles that securely holds them in place thereby reducing the danger of the skier falling onto the ground as a result of skis slipping within the carrying device or of the skis hitting another skier.

In accordance with the present invention, a device for carrying skis and poles while a skier is at a ski resort area includes a rectangular support member of plastic having a top end and a bottom end, a base member fixedly joined perpendicularly to the support member at its bottom end, a pair of wings, each wing having a rectangular shape and each wing formed from plastic, each wing has a top end and a bottom end and its bottom end is hinged to the base member in such a manner that the wings may be folded closed substantially parallel to the support member or folded open substantially in the same plane as the plane of the base member. The carrying device also includes a handle attached to the support member. The wings are secured in one closed position by a tab which is inserted in a slot in the wing adjacent to its top end through an opening in the support member adjacent to its top end and finally through a slot in the other wing adjacent to its top end. The end of the tab protruding from the second slot is secured so that it can not pass through the slot thereby securing the carrying device in the closed position. The present invention becomes a security device when a wire cable and combination lock are used to secure the tab in place.

The features of the present invention which are believed to be novel are set forth with particularity in the appended claims. Other objects and many more of the attendant advantages of this invention will be more readily appreciated as the same becomes better understood by reference to the following detailed description and considered in connection with the accompanying drawing in which like reference symbols designate like parts throughout the figures.

DESCRIPTION OF THE DRAWINGS

FIG. 1 is a perspective view of a device for carrying skis and poles constructed in accordance with the principles of the present invention.

FIG. 2 is a side view of the device shown in FIG. 1 wherein a wing of the device is open.

FIG. 5 is a top plan view of the device with one of the wings in its open position as shown in FIG. 2.

FIG. 6 is a cross-sectional view of the device shown in FIG. 1 illustrating a pair of compressional pads

DESCRIPTION OF THE PREFERRED EMBODIMENT

Figure 7:
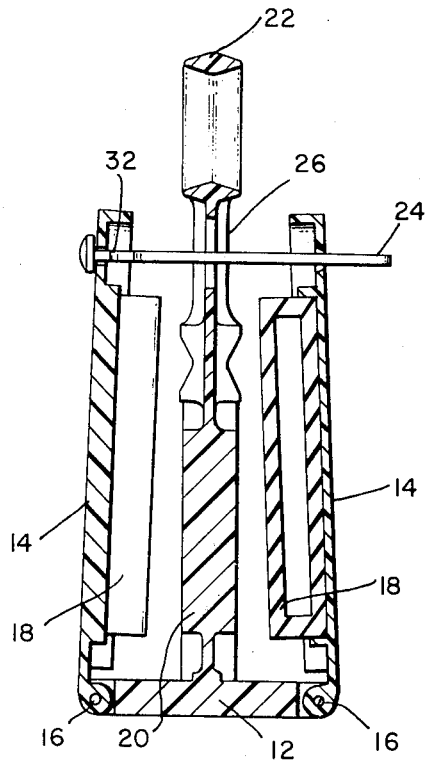
FIG. 7 is a cross-sectional view of the device shown in FIG. 1.

The preferred embodiment of the present invention can best be understood by reference to FIG. 1 wherein a device for carrying skis and poles is shown. The device 10 includes a rectangular base member 12 formed from a plastic material, a pair of rectangular wings 14 also formed from a plastic material, each wing 14 having a top end and a bottom end, which is coupled to the base member 12 by a pin 16 so that the wings 14, shown folded in FIG. 1, may be unfolded as shown in FIG. 2. The device 10 also includes a set of compression pads 18 formed from a neoprene rubber material, each of which is inserted into the inside surfaces of the wings 14. The device 10 has a rectangular support member 20 formed from a plastic material that is disposed perpendicular to the base member 12 and fixedly joined thereto at its bottom end and a handle 22 coupled to the support member 20 adjacent the top end of the support member 20. A tab 24 which is inserted into an opening 26 in the support member adjacent to its top end joins the two wings 14 securely together in a closed position. Each wing 14 has a slot 28 aligned with the opening 26 in the support member 20 and disposed adjacent to its top end. The tab 24 is anchored in place by a wire cable as shown in FIG. 1. The wire cable has its ends joined by a combination lock.

Referring now to FIG. 2 the carrying device 10 is also seen to include a set of notches 30 disposed below the opening 26 of the support member 20. The compression pads 18 are pressed against a pole inserted into these notches 30 to hold the pole in place. It should be noted that the tab 24 has its end bending downward toward the wing 14 in the opened position.

Figure 4:
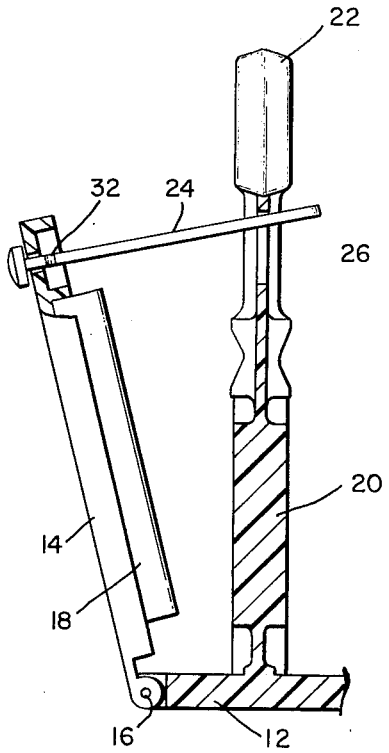
FIG. 4 is a side view of the device shown in FIG. 1 with both wings in their open positions.
Figure 3:
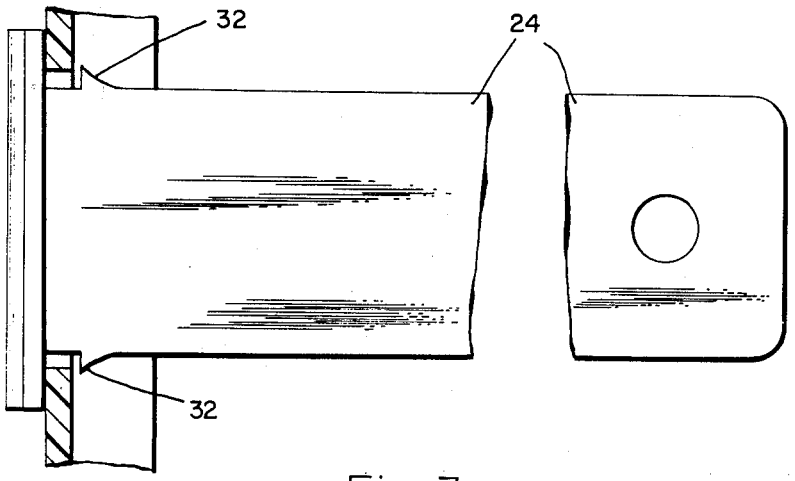
FIG. 3 is a top plan view of a tab used to hold the wings of the device securely in a closed position.

Referring now to FIG. 3 the tab 24 is shown to include a set of protrusions 32 which have been forced through the slot 28 of one of the wings 14. The tab 24 also includes a cap end 34 which presses against the slot 28 of the wing 14 in conjunction with the protrusions 32 to secure the tab 24 in the slot 28. It should be noted that the tab 14, although securely in place within the slot 28 of the wing 14, has a limited degree of rotational freedom. This freedom of rotational movement about the axis located at the slot 28 of the wing 14 allows the other wing's slot 28 to clear the tab 24 when the skier opens the device 10. Similarly, reference to FIG. 4 will indicate that the tab 24 rotates so that its end points upward thereby clearing the opening 26 in the support member 20. More particularly, it is the relative shortness of the end of the tab 24 extending through 28 of the wing 14 and the relatively wider opening 26 of the support member 20 compared to the length of the tab 24 coupled with the limited freedom of rotational movement of the tab 24 that allows the tab 24 to clear both the slot 28 of the wing 14 and the opening 26 of the support member 20.

Although the preferred embodiment of the present invention is formed from plastic which can be molded, other embodiments of the invention can be formed from a metal such as stainless steel or aluminum. The inventor has discovered that the use of a durable plastic is superior to the use of any metals because the plastic not only is more readily molded than metals, but also a plastic that is very durable is much lighter than a metal of comparable durability. Above it was mentioned that the carrying device 10 also serves as a security device for skis and poles. The use of plastic materials does not reduce the amount of security afforded the skier by this device 10 because the plastic is as difficult to saw or cut as metals are.

Referring now to both FIG. 5 and FIG. 6 the compression pads 18 are shown inserted on the inside surface of the wing 14. The compression pads 18 may be formed from any compressible material that has a memory. The hinge joining the wing 14 and the base member 12 is shown formed by the pin 16.

Referring to FIG. 7 a cross-sectional view of the device 10 indicates the relative position of the tab 24 to the wings 14 and how the tab 24 is anchored in one of the slots 28 in the wings 14.

After the proper placement of the skis in the device 10 the skier is able to carry his skis and poles in the same manner as he carries his boots in his boot tree. The wings 14 press against the skis through the compression pads 18 forcing the skis against the support member 20. This compressive force holds the skis securely in place so that the danger of the skis becoming unbalanced is eliminated. This is the primary advantage of the carrying device 10 in that it allows the skier to carry his skis around a ski resort area without placing them on his shoulder. The skier may therefore be able to walk around the ski resort area with more safety.

A secondary advantage is that skis may be stored in the device 10 because the device does not place an undue amount of stress on either ski. The skis do not touch each other and therefore their edges will not cut up the bottom of each ski.

A third advantage is that the device doubles as a security device when a wire cable is used along with a combination lock to secure the tab 24 in place. This feature is especially attractive when the skier, skiing across country, wishes to take a break from skiing and is far away from the main ski lodge. Since his carrying device 10 is light enough to carry with him while he is skiing, the skier can fasten his skis to any stationary object such as a tree, fence or post and not have to worry about the theft of his equipment. However, the majority of the time, the device would be left at the ski lodge secured to a stationary object until the skier returned. Upon his return, the skier can then place his skiing equipment in the device in order to take a break from skiing and remain confident of the security of his ski equipment.

From the foregoing, it can be seen that a device for carrying skis has been described. The device is also used as a security device for skis. Additionally it should be noted that the device is fabricated from plastic so that it is light in weight.

Furthermore, the use of this device on the ski slopes will eliminate many of the accidents caused by skiers' carrying their skis on their shoulders who lose their balance and fall or have their skis slide into another skier possible causing him injury.

The carrying device is not drawn to scale and is only represented by a schematic drawing which specifies the relationship of the components of the invention. Accordingly, it is intended that the foregoing showing made in the drawings shall be considered only as illustrations of the principles of the invention. The inventor sets out what he believes to be his invention in the claims that are appended to the foregoing specification.

What I claim is:

1. A device for carrying skis and poles of a skier when he is at a ski resort area, comprising:

a. a support member having a rectangular shape having a top end and a bottom end; said support member having an opening substantially adjacent to said top end;

b. a handle coupled to said top end of said support member;

c. a base member having a rectangular shape disposed perpendicular to said support member and fixedly joined thereto at said bottom end of said support member;

d. a first wing and a second wing, each of said wings having a rectangular shape and having a top end and a bottom end, each of said bottom ends hinged to said base member so that each of said wings may be folded open into the same plane as said base is in and may be folded closed into planes substantially perpendicular to said base member;

e. means for releaseably and adjustably holding said wings in a closed position coupled to said wings whereby a ski and a pole may be placed on each of said support members and clamped in position by said holding means which passes through said opening; and f. a compression pad coupled to the inside surface of each of said wings.

2. A device for carrying skis according to claim 1 wherein said means for holding said wings in a closed position comprises:

a. a tab having a rectangular shape which has several bores adjacent to one end and protrusions adjacent to the other end;

b. a slot disposed adjacent to said top end of each of said wings, said tab being inserted into each slot and through said opening of said support member; and c. means passing through one of said bores for holding said tab in place when said wings are in the closed position.

3. A device for carrying skis and poles according to claim 2 wherein said means for holding said tab in place is a wire cable having a first end and a second end, said ends joined by a lock to convert the carrying device into a security device.

* * * * *